US009642446B2

(12) United States Patent
Zhang

(10) Patent No.: US 9,642,446 B2
(45) Date of Patent: May 9, 2017

(54) TWO-LAYER WRISTBAND AND METHOD OF MAKING THE SAME

(71) Applicants: INVENTEC APPLIANCES (PUDONG) CORPORATION, Shanghai (CN); INVENTEC APPLIANCES (SHANGHAI) CO. LTD, Shanghai (CN); INVENTEC APPLIANCES CORP., New Taipei (TW)

(72) Inventor: Shen Zhang, Shanghai (CN)

(73) Assignees: Inventec Appliances (Pudong) Corporation, Shanghai (CN); Inventec Appliances (Shanghai) Co., Ltd., Shanghai (CN); Inventec Appliances Corp., New Taipei (TW)

( * ) Notice: Subject to any disclaimer, the term of this patent is extended or adjusted under 35 U.S.C. 154(b) by 246 days.

(21) Appl. No.: 14/502,204

(22) Filed: Sep. 30, 2014

(65) Prior Publication Data

US 2015/0237996 A1 Aug. 27, 2015

(30) Foreign Application Priority Data

Feb. 21, 2014 (CN) ..... 2014 1 0060625

(51) Int. Cl.
*A45F 5/00* (2006.01)

(52) U.S. Cl.
CPC ..... *A45F 5/00* (2013.01); *A45F 2005/008* (2013.01); *Y10T 29/49826* (2015.01)

(58) Field of Classification Search
CPC ..... A45F 5/00; A45F 5/05; A45F 2005/008; Y10T 29/49591; Y10T 29/45593; Y10T 29/4959; A44C 5/12; A44C 5/00
USPC ..... 63/3, 15, 15.1, 40
See application file for complete search history.

(56) References Cited

U.S. PATENT DOCUMENTS 1,935,504 A * 11/1933 Hargreaves ..... B21D 53/44 29/896.411
4,674,299 A * 6/1987 Azar ..... A44C 13/00 63/7
4,903,176 A * 2/1990 Chen ..... A44C 15/0015 362/103
4,999,747 A * 3/1991 Chen ..... A44C 15/0015 362/103
5,829,457 A * 11/1998 Huang ..... A45C 13/08 132/275
5,913,316 A * 6/1999 Chou ..... A45D 8/00 132/273
2010/0272767 A1* 10/2010 Koele ..... A01M 1/2061 424/403

(Continued)

*Primary Examiner* — Jack W Lavinder
(74) *Attorney, Agent, or Firm* — Muncy, Geissler, Olds & Lowe, P.C.

(57) ABSTRACT

A two-layer wristband, including: a first U-shaped symmetrical band having two hollow portion on the two ends of the first U-shaped symmetrical band, respectively, each hollow portion is formed with a vertical wall protruding from the first U-shaped symmetrical band; a second U-shaped symmetrical band having a depressed portion on its outer surface, a pair of ring-like grooves is formed in the depressed portion; wherein the first U-shaped symmetrical band is placed in the depressed portion of the second U-shaped symmetrical band, and the pair of vertical wall of the first U-shaped symmetrical band joins the pair of ring-like grooves, respectively.

8 Claims, 10 Drawing Sheets

(56) References Cited

U.S. PATENT DOCUMENTS

| | | | | |
|---|---|---|---|---|
| 2010/0285283 | A1* | 11/2010 | Kingsbury | A42B 1/004<br>428/195.1 |
| 2012/0125360 | A1* | 5/2012 | Hill | A45D 8/36<br>132/275 |
| 2015/0359304 | A1* | 12/2015 | Thomas | A44C 17/0208<br>63/1.11 |

* cited by examiner

TWO-LAYER WRISTBAND AND METHOD OF MAKING THE SAME

FIELD OF THE INVENTION

The present invention relates to a wristband and, in particular, to a wristband composed of two bands with different structures.

BACKGROUND OF THE INVENTION

Wristband is a kind of normal accessories worn on wrist. The appearance of the wristband can be any geometry shape, for example, symmetrically U-shaped. When a U-shaped wristband is worn by a user, the inner surface of the wristband contacts the user's skin. To prevent the inner surface discomforting user's skin, most of the U-shaped wristbands are made of soft and elastic materials, for example, rubber. Such materials are usually flexible without tenacity, which makes the wristband easily deformed and thus fall from user's wrist; moreover, the deformation can be irreversible and recovery of the wristband becomes difficult.

Setting a buckle structure on the wristband can prevent the abovementioned problem. Obviously, the buckle structure increases the manufacturing cost and time, also, the appearance of the wristband is changed.

Another solution of preventing the deformation is to make the wristband by an insert molding process. With such process, a rubber wristband is formed with a piece of metal on surface, which makes the wristband tougher. Herein, the appearances of a normal rubber wristband and a rubber wristband with a piece of metal in it are the same, which is a shortcoming to accessories.

To solve the abovementioned problem, the present invention provides an improved wristband structure and a making method of the same.

SUMMARY OF THE INVENTION

The present invention provides a making method of a wristband to improve the intensity and appearance of the wristband.

According to above objects, the present invention provides a two-layer wristband, comprising: a first U-shaped symmetrical band having two curved portions, an inner surface and an outer surface being opposite to the inner surface, a hollow portion is formed on each area between one of the curved portions and one of the ends of the first U-shaped symmetrical band respectively, a protruding vertical wall is disposed at the inner surface of the periphery of the hollow portion, a horizontal wall is further disposed at least a part of the protruding vertical wall, the protruding vertical wall extends away from the inner surface, the horizontal wall extends from the protruding vertical wall toward the hollow portion; and a second U-shaped symmetrical band having two curved portions, an inner surface and an outer surface being opposite to the inner surface, wherein the outer surface of the second U-shaped symmetrical band is adhered to the inner surface of the first U-shaped symmetrical band, the outer surface of the second U-shaped symmetrical band has a depressed portion, a pair of ring-shaped grooves are formed in the depressed portion, each of the ring-shaped grooves has a vertical part and a horizontal part, the first U-shaped symmetrical band is appropriately placed in the depressed portion, the protruding vertical wall of the first U-shaped symmetrical band joins the vertical part while the horizontal wall of the first U-shaped symmetrical band joins the horizontal part.

According to above objects, the present invention provides a method of making a two-layer wristband, comprising: forming a first U-shaped symmetrical band having two curved portions, an inner surface and an outer surface being opposite to the inner surface, with two areas of which each is between one of the curved portions and one of the ends of the first U-shaped symmetrical band being respectively formed to have a protruding vertical wall that is disposed at the inner surface of the periphery of the hollow portion, forming a horizontal wall disposed on at least a part of each protruding vertical wall, such that the protruding vertical wall extends away from the inner surface, and the horizontal wall extending from the protruding vertical wall toward the hollow portion; clamping and fixing the first U-shaped symmetrical band; and forming a second U-shaped symmetrical band to be partly embedded in the first U-shaped symmetrical band and an outer surface of the second U-shaped symmetrical band is adhered to the inner surface of the first U-shaped symmetrical band.

The two-layer wristband of the prevent invention provides a stronger structure than normal wristbands. Joined U-shaped symmetrical bands will not deform under slight stress and the appearance of the two-layer wristband is different from that of normal wristbands.

In the present invention, the method forms the second U-shaped symmetrical band with an insert process which joins the first & second U-shaped symmetrical bands. For no new technique is introduced, the manufacturer cost is not increased.

BRIEF DESCRIPTION OF THE DRAWINGS

The invention will become more fully understood from the detailed description given herein below illustration only, and thus is not limitative of the present invention, and wherein.

DETAILED DESCRIPTION OF THE PREFERRED EMBODIMENT

The present invention will be apparent from the following detailed description, which reference to the accompanying drawings, wherein the same references relate to the same elements. The following paragraphs describe embodiments of the disclosed two-layer wristband and method of making the same.

Figure 1:
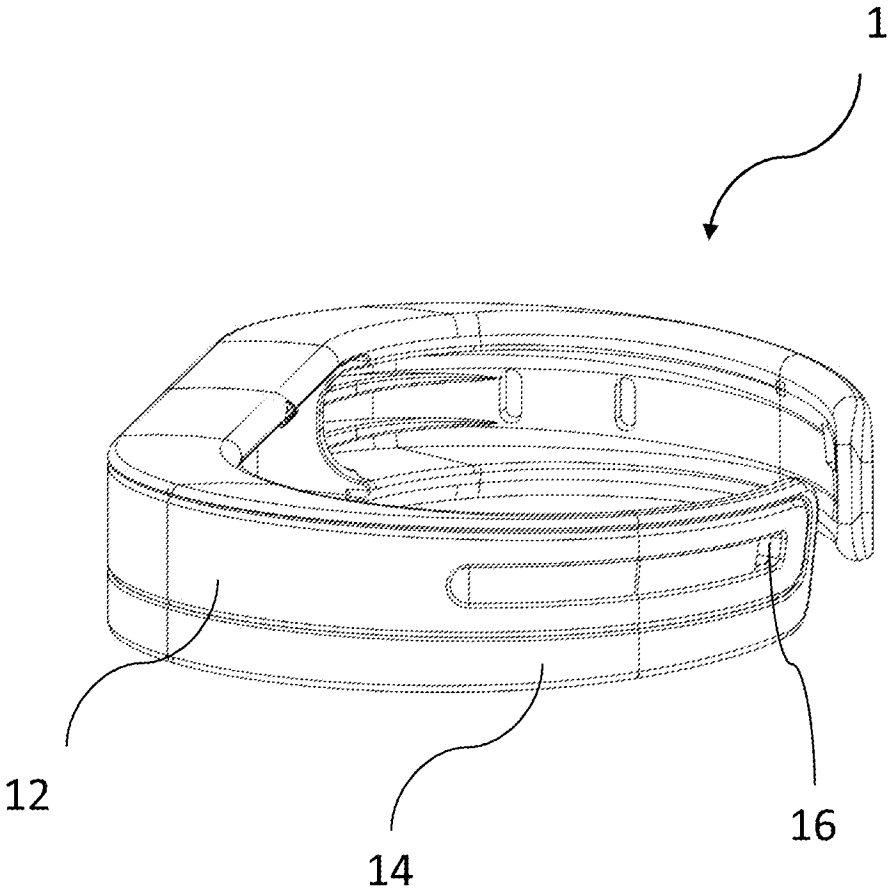
FIG. 1 is a schematic diagram of a two-layer wristband according to one embodiment of the present invention.

Please refer to FIG. 1, a schematic diagram of a two-layer wristband according to one embodiment of the present invention; the two-layer wristband 1 of the present invention is a symmetrical U-shaped band with an interval between two ends of the two-layer wristband 1. The two-layer wristband 1 is made of a first U-shaped symmetrical band 12 and a second U-shaped symmetrical band 14. Two through holes 16 are respectively formed on the portions near two ends of the two-layer wristband 1, wherein the first U-shaped symmetrical band 12 and the second U-shaped symmetrical band 14 are penetrated. Alternatively, the two-layer wristband 1 is formed without the through holes 16.

Figure 2:
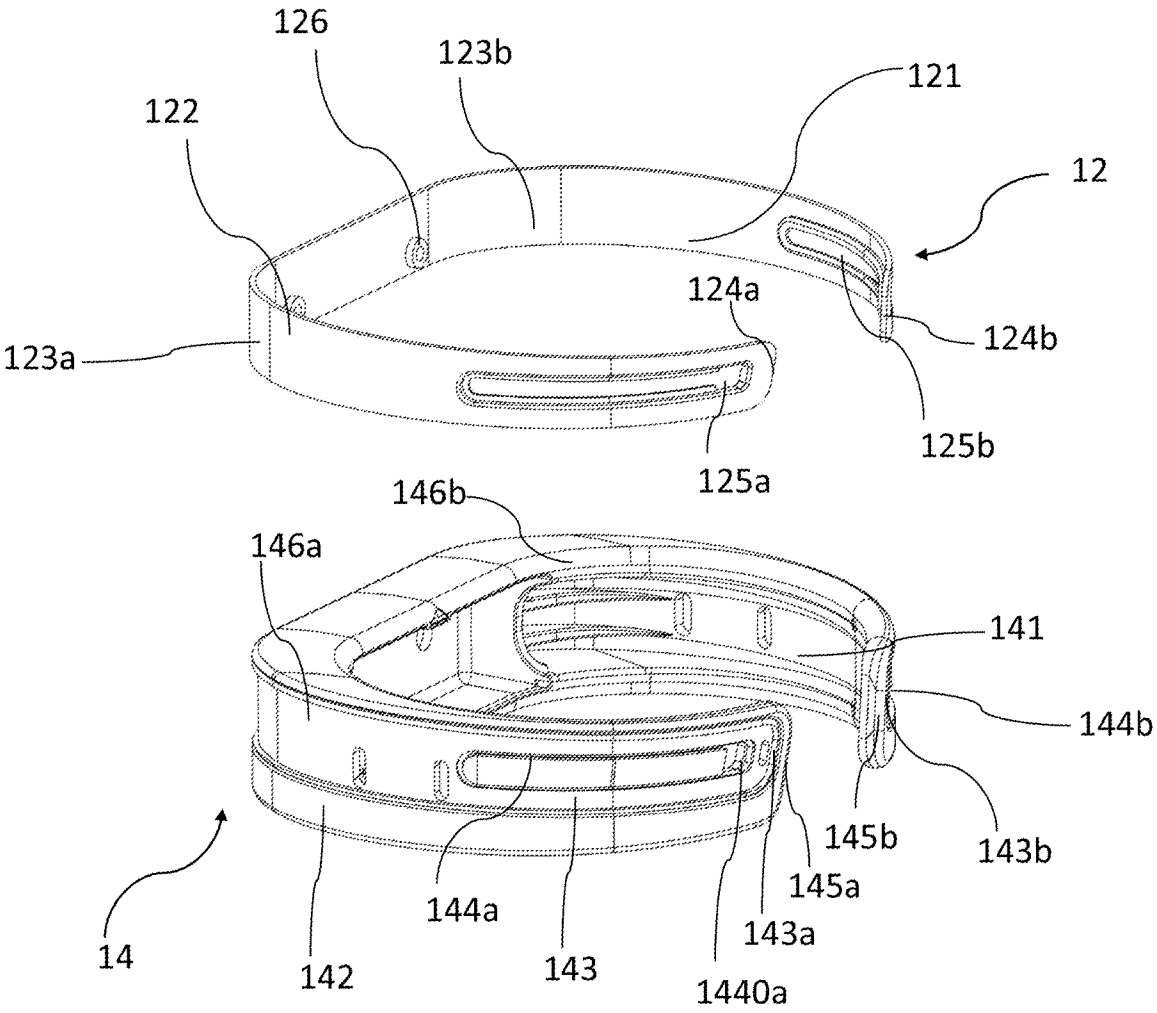
FIG. 2 is an explosion view of the two-layer wristband according to one embodiment of the present invention.

Please refer to FIG. 2 an explosion view of the two-layer wristband according to one embodiment of the present invention. As FIG. 2 shows, the first U-shaped symmetrical band 12 has two curved portions 123*a*, 123*b*, an inner surface 121 and an outer surface 122 opposite to the inner surface 121. A hollow portion 125*a* is formed on an area between the curved portion 123*a* and one end of the first U-shaped symmetrical band 12 while another hollow portion 125*b* is formed on another area between the curved portion 123*b* and another end of the first U-shaped symmetrical band 12 such that the hollow portions 125*a* and 125*b* are symmetrically formed. The hollow portions 125*a*, 125*b* both perforate the first U-shaped symmetrical band 12. In this embodiment, the length of each hollow portion 125*a*/125*b* is about a half of that from each end 124*a*/124*b* to each curved portion 123*a*/123*b*, and the length of the hollow portions 125*a*, 125*b* can be adjusted according to actual requirement. In another embodiment, areas other than the hollow portions 125*a*, 125*b* on the inner surface 121 of the first U-shaped symmetrical band 12 is formed with at least a weld screw nut 126

As shown in FIG. 2, the second U-shaped symmetrical band 14 has two curved portions 146*a*, 146*b*, an inner surface 141 and an outer surface 142 opposite to the inner surface 141. The outer surface 142 of the second U-shaped symmetrical band 14 has a depressed portion 143 between an end 145*a* of the second U-shaped symmetrical band 14 and the other end 145*b* of the second U-shaped symmetrical band 14 while the ends 143*a*, 143*b* of the depressed portion 143 are not in contact with the ends 145*a*, 145*b* of the second U-shaped symmetrical band 14. Furthermore, a pair of ring-shaped grooves 144*a*, 144*b* are respectively formed on the areas between the depressed portion 143 ends 143*a*, 143*b* and the curved portions 146*a*, 146*b*. There is an interval between one end 1440*a* of the ring-shaped groove 144*a* and one depressed portion 143 end 143*a*, and the other ring-shaped groove 144*b* has same but symmetrical structure of the ring-shaped groove 144*a*. In this embodiment, the length of a ring-shaped groove 144*a*/144*b* is same as the length of a hollow portion 125*a*/125*b*, but the length of the ring-shaped groove 144*a*, 144*b* can be adjusted according to the required length for the hollow portion 125*a*/125*b*. For the first U-shaped symmetrical band 12 is connected to the second U-shaped symmetrical band 14, the inner surface 121 of the first U-shaped symmetrical band 12 is contacted to the outer surface 142 of the second U-shaped symmetrical band 14, and the hollow portions 125*a*, 125*b* are respectively contacted to the ring-shaped groove 144*a*, 144*b*. Following description will show how to join the first U-shaped symmetrical band 12 and the second U-shaped symmetrical band 14 together.

Figure 3A:
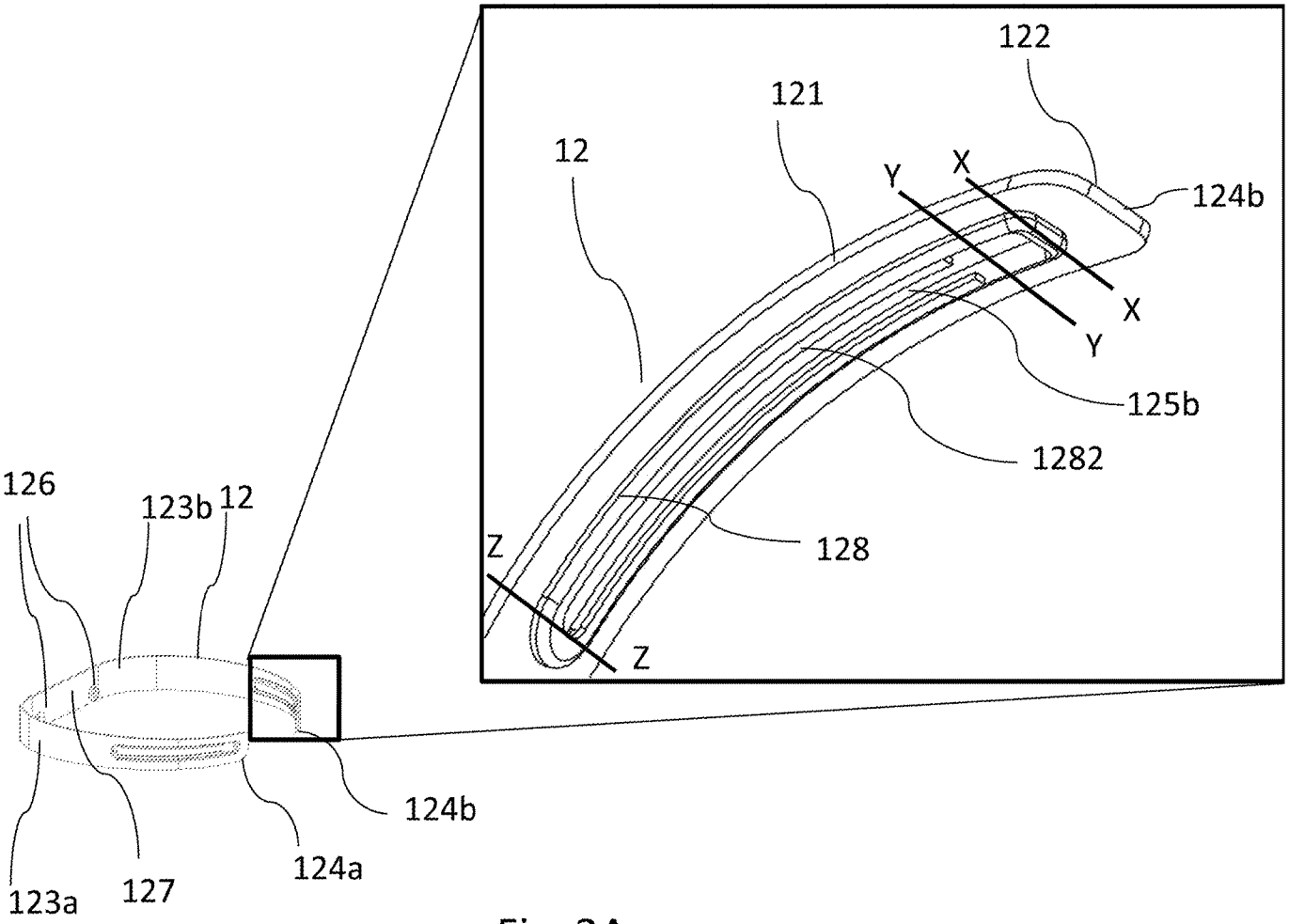
FIG. 3A is an enlarge view of an end portion of the first U-shaped symmetrical band of the two-layer wristband according to one embodiment of the present invention.

Please refer to FIG. 3A, an enlarge view of an end portion of the first U-shaped symmetrical band according to one embodiment of the present invention. As the abovementioned, two hollow portions 125*a*, 125*b* are respectively formed on the areas between one of the ends 124*a*, 124*b* and one of the curved portions 123*a*, 123*b*, meanwhile, the hollow portions 125*a*, 125*b* both perforate the first U-shaped symmetrical band 12. Also, there are respectively two intervals between one of the hollow portions 125*a*, 125*b* and one of the two ends 124*a*, 124*b* of the first U-shaped symmetrical band 12. For the first U-shaped symmetrical band 12 is symmetrical, follow description is only about to the hollow portion 125*b* and the units near it. A protruding vertical wall 128 is disposed at the inner surface 121 of the periphery of the hollow portion 125*b* and at least a part of the protruding vertical wall 128 is further formed with a horizontal wall 1282. The horizontal wall 1282 encompasses the hollow portion 125*b*. The cross-sections cut by the lines X-X, Y-Y, Z-Z are respectively showed in FIGS. 3B, 3C, and 3D.

Figure 3B:
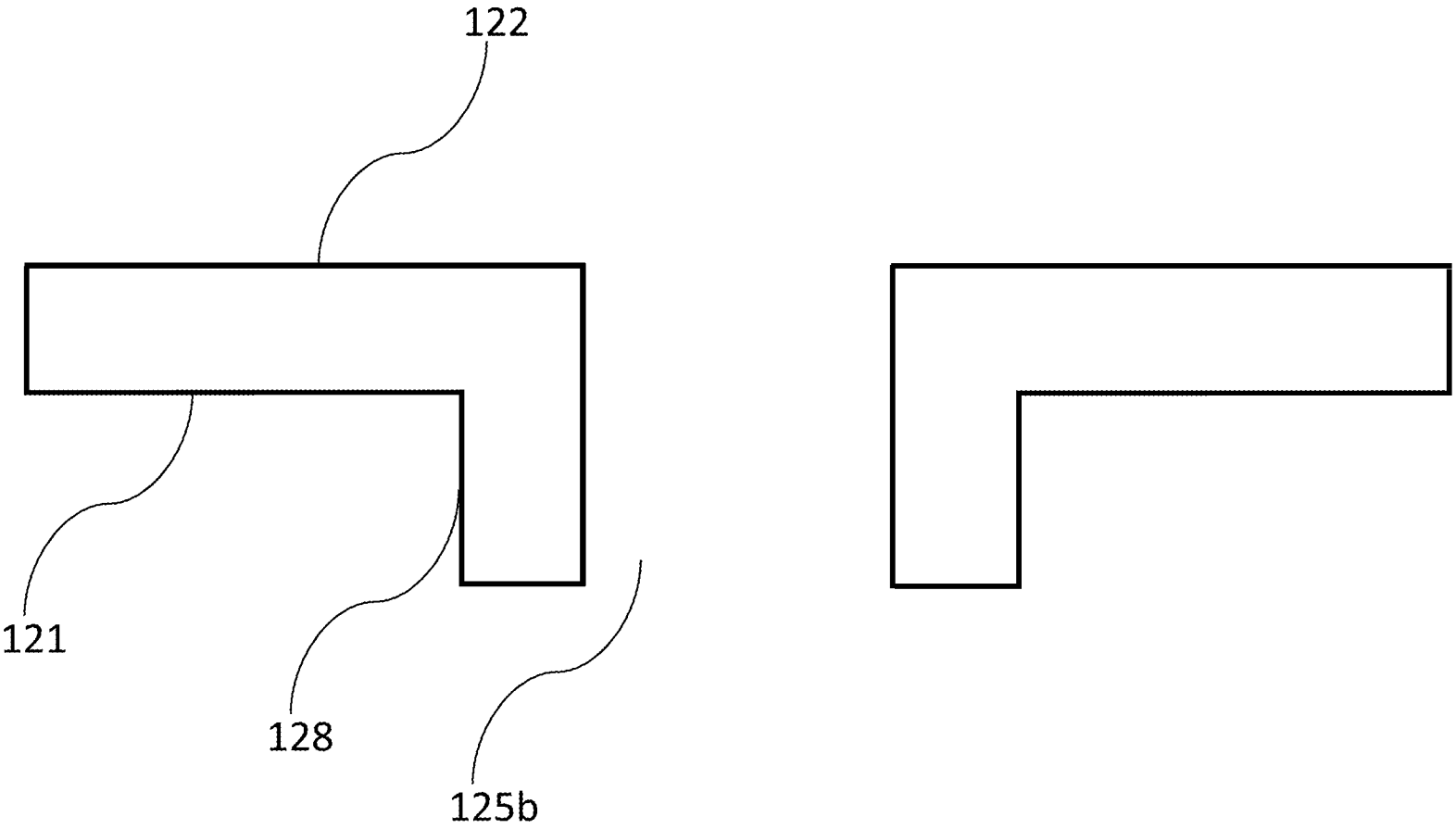
FIG. 3B is an enlarge view of a section between the lines X-X & Y-Y of the first U-shaped symmetrical band of the two-layer wristband shown in FIG. 3A.
Figure 3C:
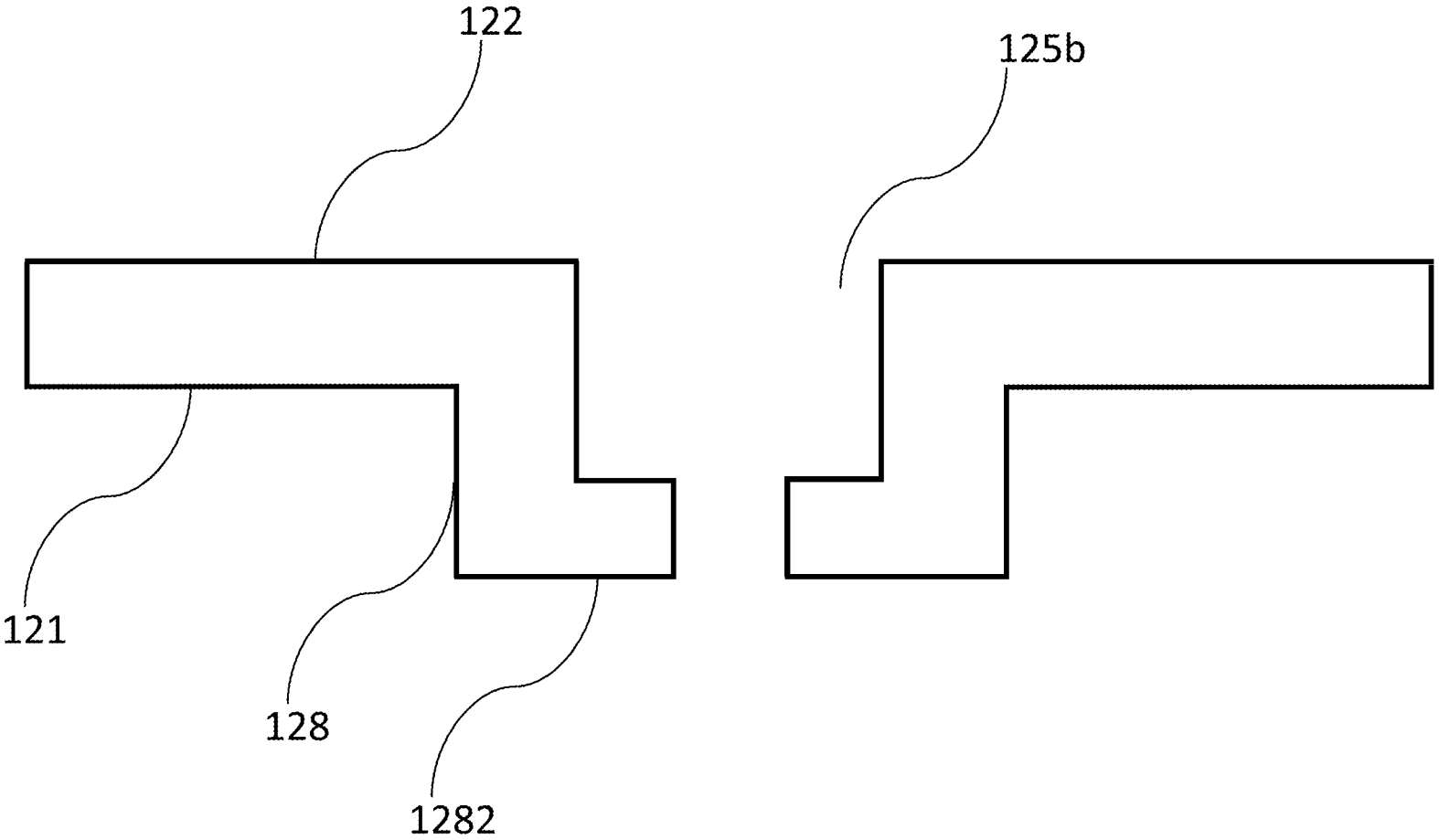
FIG. 3C is an enlarge view of a section between the lines Y-Y & Z-Z of the first U-shaped symmetrical band of the two-layer wristband shown in FIG. 3A.
Figure 3D:
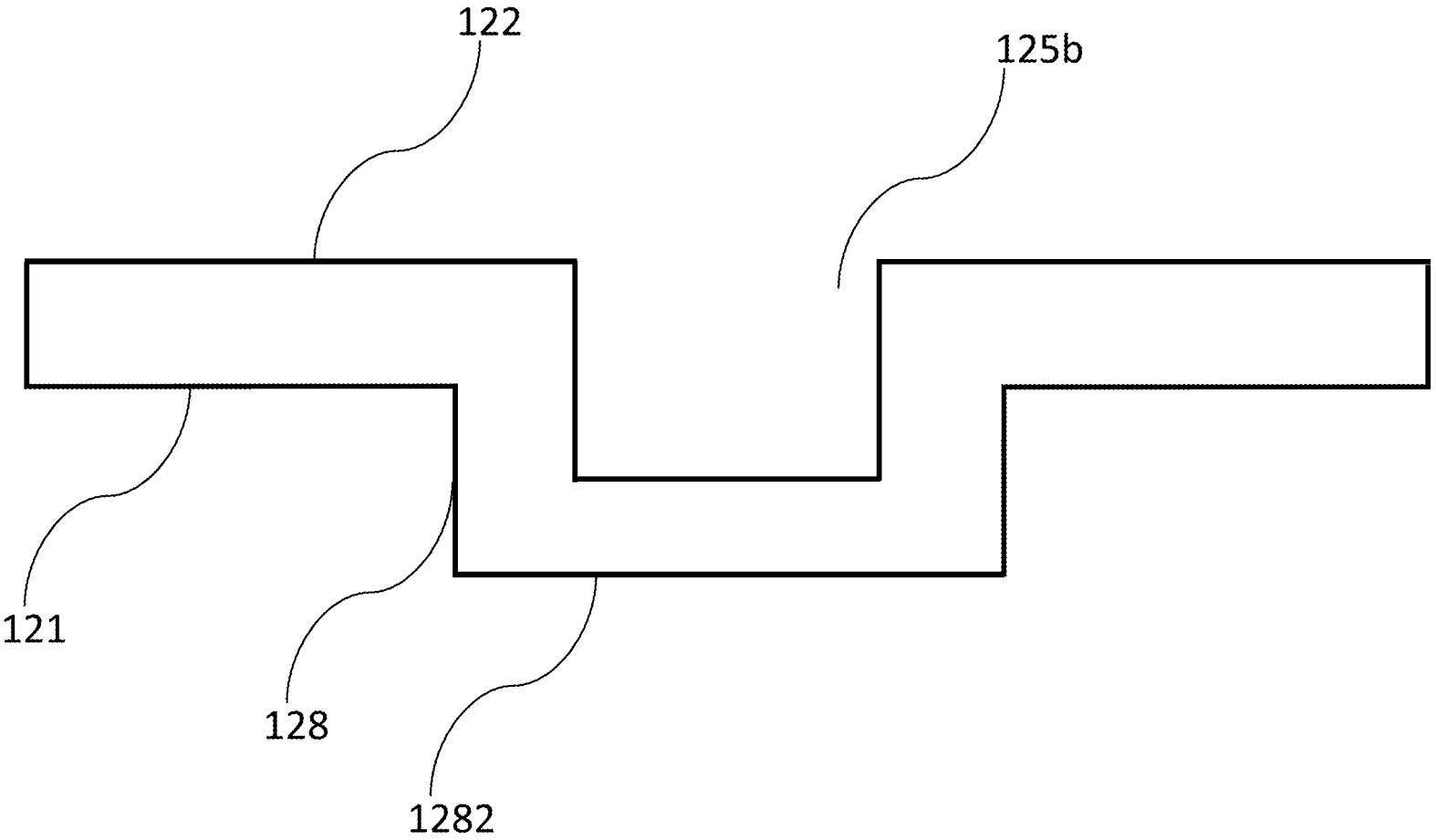
FIG. 3D is an enlarge view of a section cut-by line Z-Z of the first U-shaped symmetrical band of the two-layer wristband shown in FIG. 3A.

Firstly, at the portion near the end 124*b* of the hollow portion 125*b*, the inner surface 121 is formed with continuous vertical wall 128 as the section cut by the line X-X. Secondly, FIG. 3B is an enlarge view of a section between line X-X and line Y-Y of the first U-shaped symmetrical band 12 of the two-layer wristband 1 shown in FIG. 3A, wherein the vertical wall 128 extends away from the inner surface 121. In the area between line X-X and line Y-Y, the horizontal wall 1282 is not formed. Next, FIG. 3C shows an enlarge view of a section between the lines Y-Y & Z-Z of the first U-shaped symmetrical band of the two-layer wristband shown in FIG. 3A, wherein a horizontal wall 1282 is further disposed on the protruding vertical wall 128. In this section, the horizontal wall 1282 is not continuous, which means the hollow portion 125*b* perforates the first U-shaped symmetrical band 12 in the area between line Y-Y and line Z-Z. In addition, the vertical wall 128 extends away from the inner surface 121, and the horizontal wall 1282 extends toward the hollow portion 125*b* from the vertical wall 128. In an embodiment, the vertical wall 128 is perpendicular to the inner surface 121 while the horizontal wall 1282 is perpendicular to the vertical wall 128. Next, FIG. 3D shows an enlarge view of a section cut-by line Z-Z of the first U-shaped symmetrical band of the two-layer wristband shown in FIG. 3A, wherein the vertical wall 128 is formed with continuous horizontal wall 1282, which means the first U-shaped symmetrical band 12 is not perforated in this area. In addition, the vertical wall 128 extends away the inner surface 121 from the inner surface 121, and the horizontal wall 1282 extends toward the hollow portion 125*b* from the vertical wall 128. For the first U-shaped symmetrical band 12 is symmetrical, the displacement around the hollow portion 125*a* is same to that of the hollow portion 125*b* and not to be described herein.

Figure 4A:
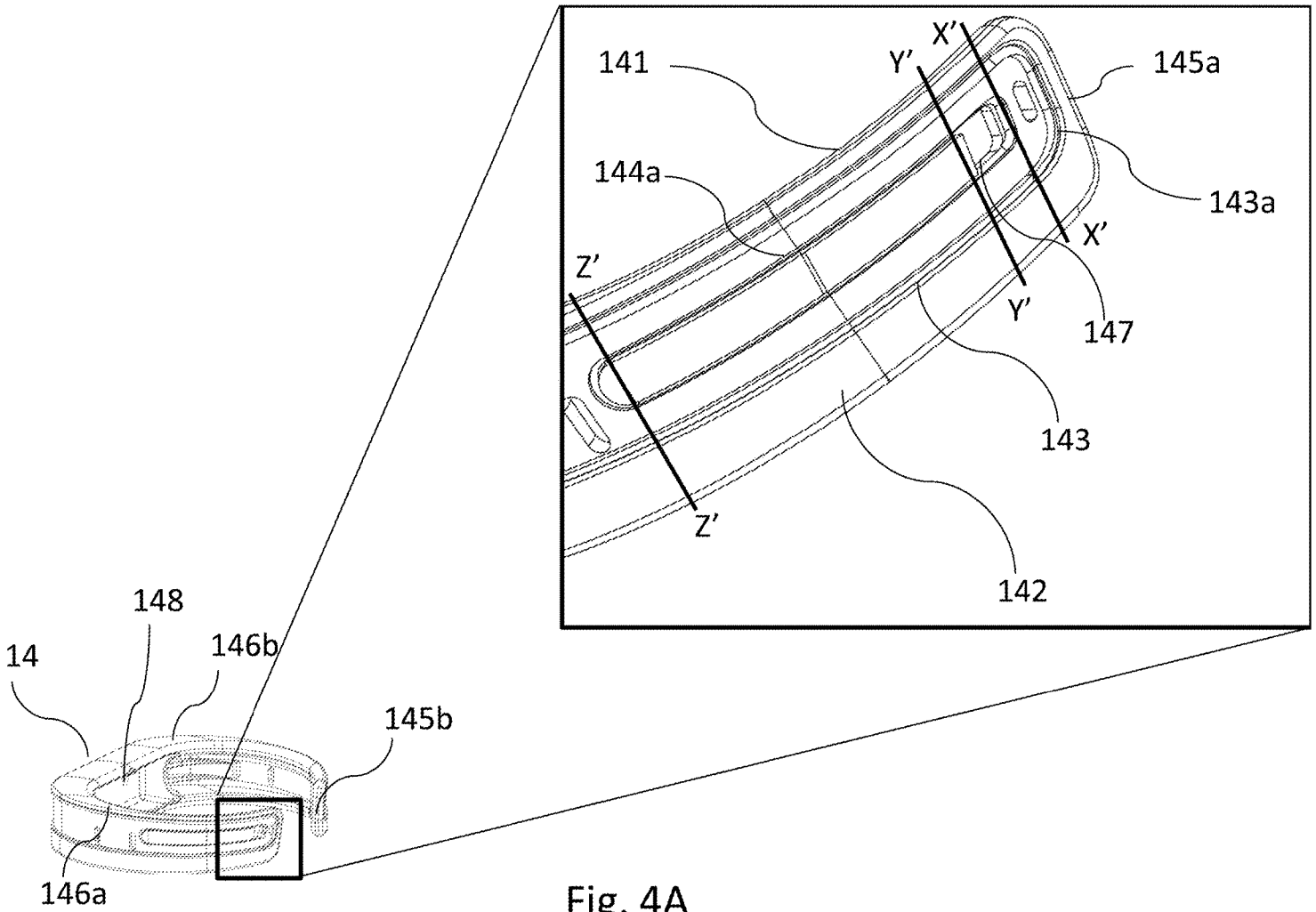
FIG. 4A is an enlarge view of an end portion of the second U-shaped symmetrical band of the two-layer wristband according to one embodiment of the present invention.
Figure 4B:
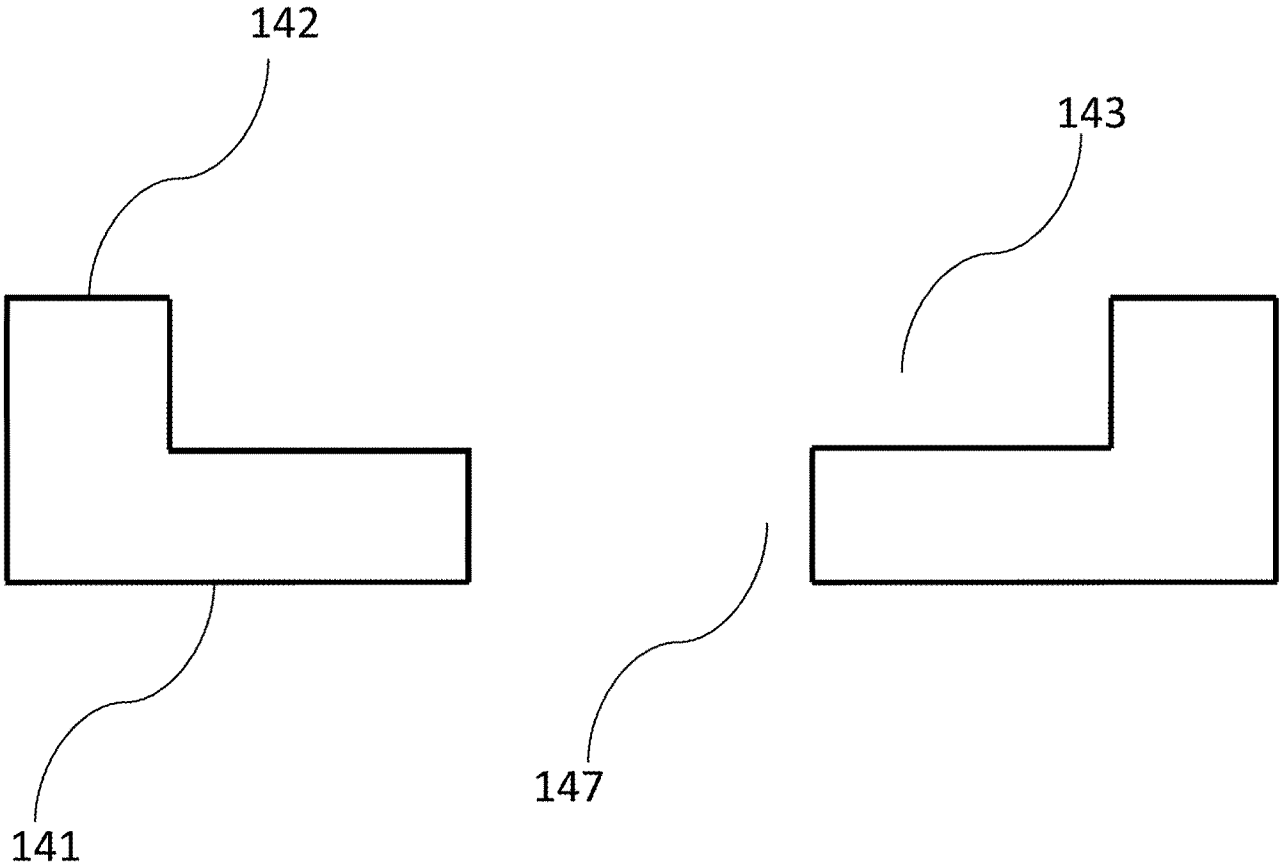
FIG. 4B is an enlarge view of a section between the lines X'-X' & Y'-Y' of the second U-shaped symmetrical band of the two-layer wristband shown in FIG. 4A.
Figure 4C:
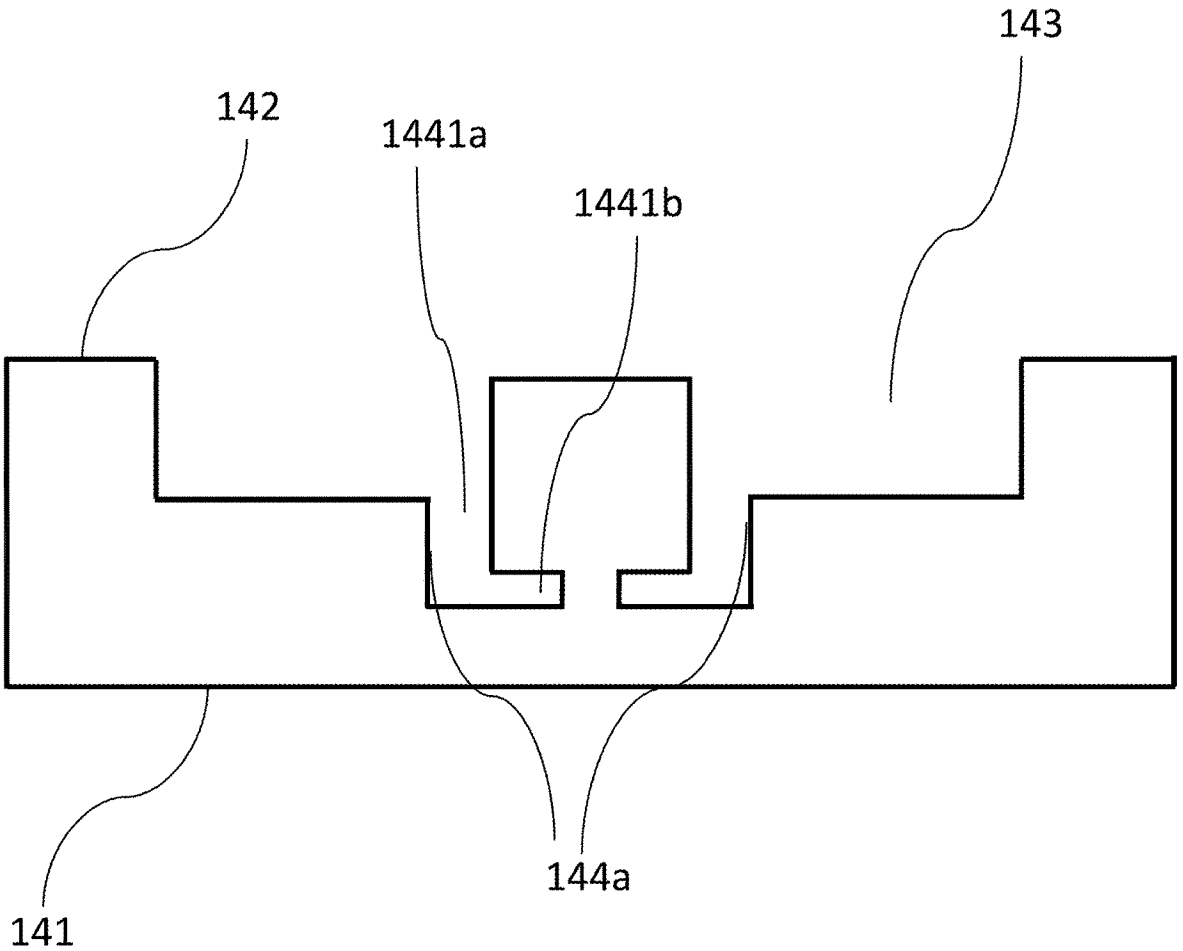
FIG. 4C is an enlarge view of a section between the lines Y'-Y' & Z'-Z' of the second U-shaped symmetrical band of the two-layer wristband shown in FIG. 4A.

Please refer to FIG. 4A, an enlarge view of an end portion of the second U-shaped symmetrical band of the two-layer wristband according to one embodiment of the present invention. FIG. 4B, 4C are the different enlarge view of sections between the lines X'-X' and Z'-Z' of the second U-shaped symmetrical band of the two-layer wristband shown in FIG. 4A. As shown in FIG. 4A and the abovementioned, the outer surface 142 of the second U-shaped symmetrical band 14 has a depressed portion 143 between an end 145*a* of the second U-shaped symmetrical band 14 and the other end 145*b* of the second U-shaped symmetrical band 14 while the ends 143*a*, 143*b* of the depressed portion 143 are not in contact with the ends 145*a*, 145*b* of the second U-shaped symmetrical band 14. Furthermore, a pair of ring-shaped grooves 144*a*, 144*b* are respectively formed on the areas between the depressed portion 143 ends 143*a*, 143*b* and the curved portions 146*a*, 146*b*. In addition, a through hole 147 perforated the second U-shaped symmetrical band 14 is formed near the ends 143*a* of the depressed portion 143. In the embodiment of the first U-shaped symmetrical band 12 having at least a weld screw nut 126, the second U-shaped symmetrical band 14 has at least a screw nut through hole 148 corresponded to the weld screw nut 126, while the number of the weld screw nut 126 is the as that of the screw nut through hole 148.

FIG. 4B shows an enlarge view of a section between the lines X'-X' & Y'-Y' of the second U-shaped symmetrical band of the two-layer wristband shown in FIG. 4A, wherein the outer surface 142 of the second U-shaped symmetrical band 14 has a depressed portion 143, and the depressed portion 143 further has a through hole 145 perforating the second U-shaped symmetrical band 14. Next, FIG. 4C shows an enlarge view of a section between the lines Y'-Y' & Z'-Z' of the second U-shaped symmetrical band of the two-layer wristband shown in FIG. 4A, wherein the ring-shaped groove 144*a* encompasses the center area of the depressed portion 143. In the section, the ring-shaped groove 144*a* is consisted of a pair of vertical part 1441*a* and a pair of horizontal part 1441*b*, while there is an interval between the horizontal parts 1441*b*. Furthermore, the vertical parts 1441*a* extend toward the second U-shaped symmetrical band 14 inner surface 141 from the second U-shaped symmetrical band 14 outer surface 142, while the horizontal parts 1441*b* perpendicular to the vertical parts 1441*a* extend toward the center of the ring-shaped groove 144*a*. The section at the other side of the line Z'-Z' is similar to the section shown in FIG. 4C, the difference is that the interval between the horizontal parts 1441*b* is narrower as the section is farther from the line Z'-Z' and then the horizontal parts 1441*b* will connect to each other as the section is far enough from the line Z'-Z'. For the second U-shaped symmetrical band 14 is symmetrical, the displacement of the units near the end 145*b* of the outer surface 142 is not to be described herein.

The ends 124*a*, 124*b* of the first U-shaped symmetrical band 12 respectively correspond to the ends 145*a*, 145*b* of the second U-shaped symmetrical band 14 and the depressed portion 143 of the second U-shaped symmetrical band 14 contains the first U-shaped symmetrical band 12 appropriately, as a result, the first U-shaped symmetrical band 12 is combined with the second U-shaped symmetrical band 14. Meanwhile, the ring-shaped grooves 144*a*, 144*b* near the second U-shaped symmetrical band 14 ends 145*a*, 145*b* contain and join with the pair of vertical wall 128, the pair of horizontal wall 1282 of the first U-shaped symmetrical band 12. For example, the vertical wall 128 joins with the vertical portion 1441*a* of the ring-shaped groove 144*a*, and the horizontal wall 1282 joins with the horizontal portion 1441*b* of the ring-shaped groove 144*a* which both make the first U-shaped symmetrical band 12 combine with the second U-shaped symmetrical band 14 steadily.

Furthermore, the lines X-X, Y-Y near the first U-shaped symmetrical band 12 end 124*b* shown in FIG. 3A respectively correspond to the lines X'-X', Y'-Y' near the second U-shaped symmetrical band 14 end 145*a* shown in FIG. 4A. Obviously, the hollow portion 125 between the lines X-X & Y-Y and the through hole 147 between the lines X'-X' & Y'Y' overlap each other to form a through hole 16 shown in FIG. 1. In the embodiment of having at least a weld screw nut 126 on the first U-shaped symmetrical band 12 and at least a screw nut through hole 148 on the second U-shaped symmetrical band 14 corresponding to the weld screw nut 126, each screw nut through hole 148 appropriately contains a weld screw nut 126, so that the first U-shaped symmetrical band 12 combine with the second U-shaped symmetrical band 14 more steadily. In another embodiment, there is a glue between the inner surface 121 of the second U-shaped symmetrical band 12 and the outer surface 142 of the second U-shaped symmetrical band 14, so that the first U-shaped symmetrical band 12 combine with the second U-shaped symmetrical band 14 more steadily.

Figure 5:
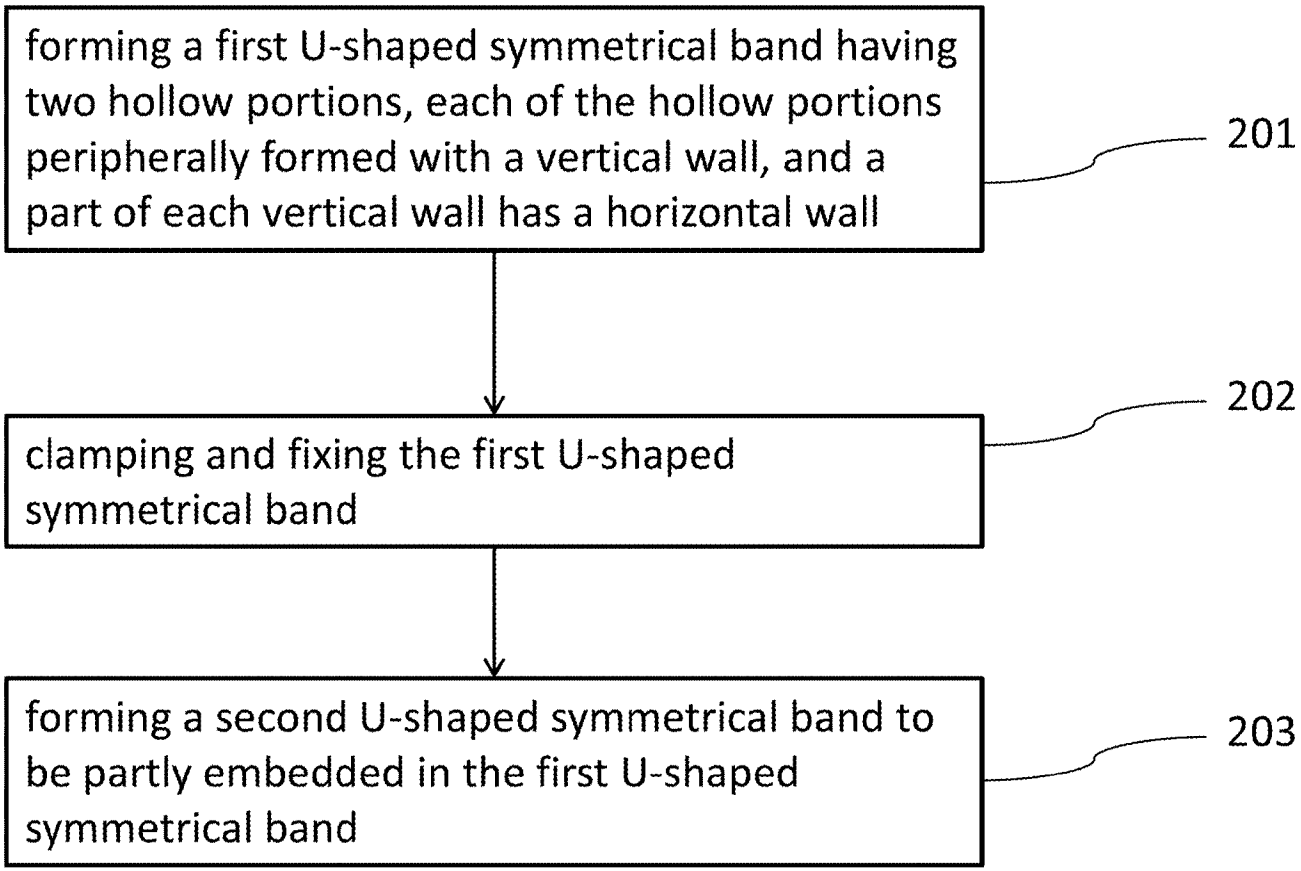
FIG. 5 is a flow chart illustrating method of making the two-layer wristband according to one embodiment of the present invention.

Please refer to FIG. 5, a flow chart illustrating method of making the two-layer wristband according to one embodiment of the present invention. As FIG. 5 shows, the two-layer wristband making method comprises the steps of:

Step 201: forming a first U-shaped symmetrical band 12 having two curved portions 123*a*, 123*b*, an inner surface 121 and an outer surface 122 being opposite to the inner surface 121, with two areas of which each is between one of the curved portions 123*a*, 123*b* and one of the ends 124*a*, 124*b* of the first U-shaped symmetrical band 12 being respectively formed to be have a hollow portion 125*a*/125*b* peripherally formed with a vertical wall 128 protruding from the inner surface 121, forming at least a part of each vertical wall 128 to have a horizontal wall 1282 with the protruding vertical wall 128 extends away from the inner surface 121, and the horizontal wall 1282 extending from the vertical wall 128 toward the hollow portion 125*a*/125*b*

In another embodiment, forming at least a weld screw nut 126 on an area other than the hollow portion of the first U-shaped symmetrical band 12 inner surface 121.

Step 202: clamping and fixing the first U-shaped symmetrical band 12. In an embodiment, the clamping is acting on part of the hollow portion 125.

In an embodiment, spreading glue on the inner surface 121 of the first U-shaped symmetrical 12.

Step 203: forming a second U-shaped symmetrical band 14 to be partly embedded in the first U-shaped symmetrical band 12 and an outer surface 142 of the second U-shaped symmetrical band 14 is adhered to the inner surface 121 of the first U-shaped symmetrical band 12. The outer surface 142 of the second U-shaped symmetrical band 14 is formed with a depressed portion 143 to contain the first U-shaped symmetrical band 12. Meanwhile, the vertical portion 1441*a* and the horizontal portion 1441*b* of a ring-like groove 144*a* of the depressed portion 143 respectively join the vertical wall 128 and horizontal wall 1282 of the first U-shaped symmetrical band 12, which makes the first U-shaped symmetrical band 12 and the second U-shaped symmetrical band 14 combine each other to be the two-layer wrist band 1 shown in FIG. 1.

In an embodiment of forming at least a weld screw nut 126 on an area other than the hollow portion of the first U-shaped symmetrical band 12 inner surface 121, forming at least a screw nut through hole 146 on the outer surface 142 of the second U-shaped symmetrical band 14 to corresponds to the weld screw nut 126. The screw nut through hole 146 contains and joins the weld screw nut 126 which makes the first U-shaped symmetrical band 12 combine with the second U-shaped symmetrical band 14 more steadily.

In the above embodiments, the second U-shaped symmetrical band 14 is formed in an insert molding process; thus, the material of the second U-shaped symmetrical band is but not limited to macromolecule material, for example, Polyvinyl Chloride and Polypropylene. In addition, glue is separated between the first U-shaped symmetrical band 12 and the second U-shaped symmetrical band 14 to be a glue layer, which makes the first U-shaped symmetrical band 12 combine with the second U-shaped symmetrical band 14 more steadily.

In the present invention, the first U-shaped symmetrical band 12 and the second U-shaped symmetrical band 14 is made of different material. In an embodiment, the first U-shaped symmetrical band 12 is made of metal while the second U-shaped symmetrical band 14 is made of soft material, like macromolecule material. For metal is a material with hardness and elasticity, the first U-shaped symmetrical band 12 prevents deformation of the second U-shaped symmetrical band 14 when the two-layer wristband 1 is pressed, and then the two-layer wristband 1 is able to be worn appropriately without a buckle structure. In addition, the first U-shaped symmetrical band 12 outer surface 122 and the second U-shaped symmetrical band 14 are exposed and able to be seen, the appearance is unique and different from that of a single material wristband.

In the present invention, the first U-shaped symmetrical band 12 is partly embedded in the second U-shaped symmetrical band 14 which makes the first U-shaped symmetrical band 12 combine with the second U-shaped symmetrical band 14 more steadily.

In the present invention, the second U-shaped symmetrical band 14 is made with an insert molding process. No new technique is introduced into the process, thus, the manufacturer cost is not increased.

Although the invention has been described with reference to the preferred embodiments, this description is not meant to be construed in a limiting sense. It is apparent to those skilled in the art that a variety of modifications and changes may be made without departing from the scope of the present invention which is intended to be defined by the appended claims.

What is claimed is:

1. A two-layer wristband, comprising:

a first U-shaped symmetrical band having two curved portions, an inner surface and an outer surface being opposite to the inner surface, a hollow portion is formed on each area between one of the curved portions and one of the ends of the first U-shaped symmetrical band respectively, a protruding vertical wall is disposed at the inner surface of the periphery of the hollow portion, a horizontal wall is further disposed at least at a part of the protruding vertical wall, the protruding vertical wall extends away from the inner surface, the horizontal wall extends from the protruding vertical wall toward the hollow portion; and a second U-shaped symmetrical band having two curved portions, an inner surface and an outer surface being opposite to the inner surface, wherein the outer surface of the second U-shaped symmetrical band is adhered to the inner surface of the first U-shaped symmetrical band, the outer surface of the second U-shaped symmetrical band has a depressed portion, a pair of ring-shaped grooves are formed in the depressed portion, each of the ring-shaped grooves has a vertical part and a horizontal part, the first U-shaped symmetrical band is appropriately placed in the depressed portion, the vertical wall of the first U-shaped symmetrical band joins the vertical part while the horizontal wall of the first U-shaped symmetrical band joins the horizontal part.

2. The two-layer wristband of claim 1, wherein the protruding vertical wall of the first U-shaped symmetrical band encompasses the hollow portion.

3. The two-layer wristband of claim 1, further comprising two through holes being respectively formed near two ends of the second U-shaped symmetrical band, and positioned to correspond to the hollow portions of the first U-shaped symmetrical band without a formation of the horizontal wall.

4. The two-layer wristband of claim 1, wherein the inner surface of the first U-shaped symmetrical band is further formed with at least a weld screw nut at an area other than the hollow portion, and the outer surface of the second U-shaped symmetrical band is further formed with a screw nut through hole corresponding to the weld screw nut, the weld screw nut is placed appropriately in the screw nut through hole.

5. The two-layer wristband of claim 1, further comprising a glue layer disposed between the inner surface of the first U-shaped symmetrical band and the outer surface of the second U-shaped symmetrical band.

6. The two-layer wristband of claim 1, wherein the first U-shaped symmetrical band is made of metal.

7. The two-layer wristband of claim 1, wherein the second U-shaped symmetrical band is made of macromolecule material.

8. The two-layer wristband of claim 7, wherein the macromolecule material is one of Polyvinyl Chloride and Polypropylene.

* * * * *